US008336882B2

(12) United States Patent
Nord

(10) Patent No.: US 8,336,882 B2
(45) Date of Patent: Dec. 25, 2012

(54) CASINO POKER GAME

(76) Inventor: Joel Nord, Bakersfield, CA (US)

( * ) Notice: Subject to any disclaimer, the term of this patent is extended or adjusted under 35 U.S.C. 154(b) by 47 days.

(21) Appl. No.: 13/105,254

(22) Filed: May 11, 2011

(65) Prior Publication Data

US 2012/0043719 A1 Feb. 23, 2012

Related U.S. Application Data

(60) Provisional application No. 61/375,018, filed on Aug. 18, 2010.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 4,836,553 | A | 6/1989 | Suttle et al. | |
| 5,167,413 | A | 12/1992 | Fulton | |
| 5,288,081 | A | 2/1994 | Breeding | |
| 5,685,774 | A | 11/1997 | Webb | |
| 7,614,624 | B2 * | 11/2009 | Kling et al. | 273/274 |

* cited by examiner

*Primary Examiner* — Michael Dennis
(74) *Attorney, Agent, or Firm* — Michael Fedrick; Loza & Loza, LLP

(57) ABSTRACT

A poker game involving cards dealt to individual players and community cards used by all players, in which bets can be placed on whether a wild card is dealt into the hand of an individual player or as a community card.

22 Claims, 4 Drawing Sheets

CASINO POKER GAME

BACKGROUND

Poker has a long history, and has spawned numerous variations, including five card stud poker, seven card stud poker, draw poker, and Texas hold'em. Such games were, at one time, primarily played privately. In the 1980's, however, a variation called Caribbean stud poker, described in U.S. Pat. No. 4,836,553, became a popular casino game. Since then a number of casino poker games have been created, including those described in U.S. Pat. No. 5,167,413 to Fulton ("Double Down Stud"), U.S. Pat. No. 5,288,081 to Breeding ("Let It Ride"), and U.S. Pat. No. 5,685,774 to Webb ("Three Card Poker").

SUMMARY

There remains a need for card games which are appropriate for casino gaming and which also generate enthusiasm among players. The present game meets this need by providing a novel method of playing a poker game which includes a wild card and provides a plurality of betting opportunities. In addition to an ante bet, the present game provides a first betting opportunity for a player to place a bet (a "bonus bet") that the player's hand will be higher in rank than a first predetermined rank, with hands being ranked according to predetermined rules such as standard poker rules. A second betting opportunity in the present game allows a player to place a bet (a "joker bet") that the wild card will be dealt into the player's hand or as a community card. Following these betting opportunities, at least two cards, and preferably at least four or five cards, are dealt to each player, and at least one, preferably two community cards are dealt in a manner that conceals their identity. At least five cards overall, and preferably seven cards (including the community cards), can be selected from to form a player's hand.

The present game further provides a third betting opportunity for a player to place a third bet that the cards dealt into the player's hand, in combination with a first community card, can form a hand that is higher in rank than the hands of any other players against whom the player is betting. Generally, a player must either fold or place a bet during the third betting opportunity. In a preferred embodiment in which two community cards are dealt, following the revelation of the identity of the first community card, a fourth betting opportunity is provided in which each player must either check or place a fourth bet prior to the time that the identity of a second community card is revealed, with the fourth bet being that the cards dealt into the player's hand, in combination with the first and/or second community cards, can form a hand that is higher in rank than the hands of the other players against whom the player is betting.

Once the community cards have been revealed, the players' hands are evaluated in order to determine which player has the hand with the highest rank. Once this is determined, the ante, third, and fourth bets can be paid to the player with the hand of the highest rank. In a preferred embodiment, a player bets only against a single gaming entity such as a casino, in which case the casino preferably must have a hand of a predetermined rank or higher in order to pay the third or fourth bets. Additionally, the bonus bet is paid if the cards in the hand of a player who has placed such a bet, in combination with any community cards, can form a hand that is higher in rank than the first predetermined rank. The joker bet is paid if the wild card was dealt into a player's hand or as a community card during the game. The bonus bet and joker bet can be fixed payout bets.

At the outset of the present method, a player playing the present game determines whether to place a first bet that cards in the player's hand together with any community cards can form a hand that's higher in rank than a first predetermined rank, with hands being ranked according to predetermined rules. The player also determines whether to place a second bet that the wild card will be dealt into the player's hand or as a community card. After these steps, the player receives two or more cards, and determines whether to place a third bet that the player's hand, in combination with one or more community cards provided during the game, will be higher in rank than the hands of other players against whom the player is betting. The one or more community cards are provided in a manner that conceals the community cards' identities, and the third bet is made prior to revealing the identities of the community cards. The player then receives payment if the player placed the first bet and the player's hand is determined to be higher in rank than the first predetermined rank. The player also receives payment if the player placed the second bet and the wild card is dealt into the player's hand or as a community card. In addition, the player receives payment if the player placed the third bet and the cards in the player's hand, in combination with any or all of the community cards provided during the game, forms a hand that is higher in rank than the hands of the other players against whom the player was betting. In a preferred embodiment, the player is playing only against a casino.

In another embodiment, a board game for two or more players is provided. The game includes a set of cards, including at least one wild card, to be dealt to players of the game; tokens for use in wagering; and a playing field having areas for wagering and for placement of one or more community cards. The playing field includes at least two playing areas, with each playing area comprising the five betting fields: an ante betting field, a wild card betting field, a bonus betting field, a play betting field, and an option betting field. The playing field preferably comprises a substantially flat surface, and can be made from cardboard, plastic, or cloth, for example.

In an alternative embodiment, the present game and method can be implemented in electronic form. In electronic versions of the present game, the playing field comprises an electronic display, and the cards are displayed electronically.

FIGURES

DESCRIPTION

Definitions

Figure 1:
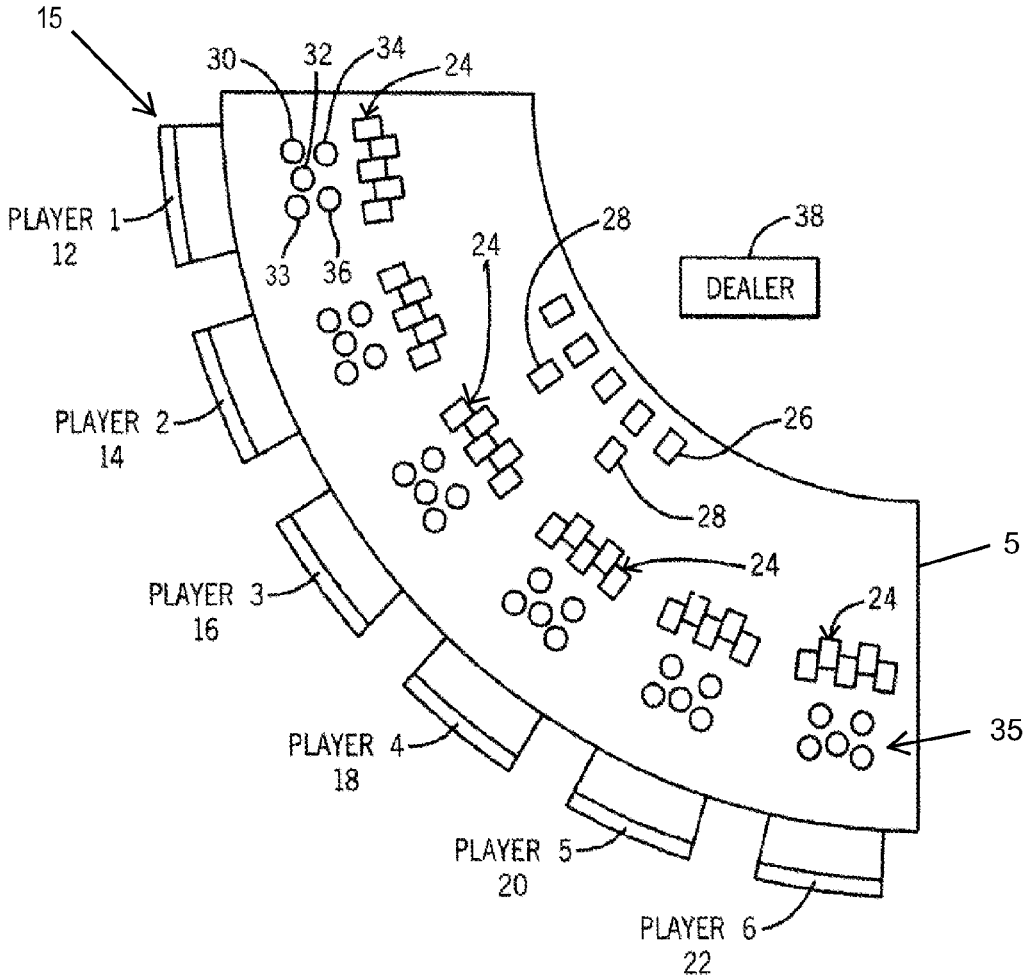
FIG. 1 is an illustration of a gaming table arranged for playing the present game.

As used herein, the following terms and variations thereof, including singular and plural variations, have the meanings given below, unless a different meaning is clearly intended by the context in which such term is used.

"Ante" refers to a bet placed at the beginning of a round of play of the present game.

"Bet," as a verb, refers to the act of placing a wager. As a noun, a bet refers to a wager.

"Betting field" comprises an area, either in physical form or displayed electronically, in which a wager is placed or displayed.

"Cards" refer to tokens or other means of displaying an identifier, such as a numerical value, suit, face card symbol, or other identifier. Typically cards are formed from cardboard or stiff paper and display the identifier on only one side of the card. Cards can also be implemented in electronic form, for example.

"Casino" refers to a gaming entity other than an individual, e.g. a corporation, partnership, tribe, or other organization or entity.

"Check" refers to the act of waiving the right to initiate the betting in a round of play of a game. This can also be referred to as "staying." Checking can involve retaining the right to act if another player initiates the betting in some embodiments.

"Community card" refers to a card that can be used by all players in a game in forming a hand.

"Dealer" refers to an individual who is responsible for distributing cards to players of the present game.

"Deck" refers to a set of playing cards. In the present game, the deck typically consists of a standard set of 52 cards and an additional wild card, typically a joker.

"Draw" refers to the act of replacing cards in a player's hand, generally by the player discarding one or more cards and receiving an equal number of cards from the deck being used.

"Discard" refers to the act of removing one or more cards from a hand.

"Fixed payout" refers to an amount paid for a wager that is won, with the amount being determined in a manner that is fixed prior to wagering. For example, a predetermined multiple of a bet can be paid as a fixed payout.

"Fold" refers to the act of ending participation in a game or in a portion of a game. Folding generally further involves forfeiting the player's interest in one or more bets placed by the player, such as ante bets and bets placed that relate to a contest between the ranking of the player's hand as compared to the hands of other players.

"Gaming" and "gambling" refer to an activity in which something of value is placed at risk of loss for the opportunity to obtain a benefit.

"Gaming entity" refers to an individual, corporation, tribe, partnership, or other organization or entity which has the right and ability to place and/or accept a wager.

"Hand" refers to a set of cards associated with (belonging to) a player during a game.

"Option" refers to the choice given to a player to raise a bet.

"Player" refers to an individual or other gaming entity which engages in playing the present game.

"Raise" refers to the act of placing a bet which increases the amount of a previous wager.

"Slot machine" refers to a gaming device into which a player may deposit coins into a slot, or may place a wager using other forms of consideration, and from which certain numbers of coins or other consideration are paid out when a particular configuration of symbols appear on the machine. When card games are played with slot machines, such as video poker games, the symbols appearing on the machine are cards.

"Wager" as a verb means to place something of value (money or other consideration) at risk of loss for the opportunity to obtain a benefit, usually additional money or other consideration. As a noun, "wager" refers to an amount of money or other consideration that is placed at risk of loss. In some embodiments, a wager can comprise a token or tokens of nominal value.

"Wild card" refers to a playing card that can be deemed to be any card from the set of cards used in an embodiment of the present game, e.g. a card of any suit, face card denomination, and/or numerical value. A wild card is preferably different from other cards used in the present game, i.e. it comprises a different identifier.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Game Methods

The present game is a card game played with a set of cards that, when dealt into hands, can be ranked in an ordered series of hands. As in known poker games, players can compete with a casino or with other players to determine which player can form the highest ranking hand. In addition, the present game provides opportunities to place a plurality of different bets.

Preferably, the set of cards used in the present game is a standard set of 52 playing cards, as are used to play card games such as bridge, further including one or more additional cards which act as a wild card. In a preferred embodiment, the set of cards used in the present game is a standard set of 52 playing cards that includes a single additional card that differs from the remaining cards and is designated as a wild card, preferably a joker. In some embodiments, two wild cards are used.

The ranking of hands in the present game is preferably determined according to standard poker rules. Table 1 below lists standard poker hands, ranked from highest to lowest. Other rankings can be used in various embodiments of the present game.

TABLE 1

Ranking of Hands

| Rank (High to Low) | Hand | Cards Forming the Hand |
|---|---|---|
| 1 | Royal Flush | Ten, Jack, Queen, King, and Ace, all of the same suit. |
| 2 | Straight Flush | Five cards in a row, all of the same suit, but not Ace high. |
| 3 | Four of a kind | Four cards of the same rank, e.g. King-King-King-King. |
| 4 | Full House | Three cards of the same rank, plus a pair, e.g. King-King-King-Ace-Ace. |
| 5 | Flush | Five cards of the same suit, but not in a row. |
| 6 | Straight | Five cards in a row, e.g. 5, 6, 7, 8, 9. |
| 7 | Three of a kind | Three cards of the same rank, e.g. King-King-King. |
| 8 | Two pair | Two pairs of cards, e.g. King-King-Ace-Ace. |
| 9 | One pair | Any two cards of the same rank, e.g. King-King. |
| 10 | High card | The highest card in a player's hand, when none of the other ranked hands are present (Aces typically designated as the highest ranking card). |

Other standard poker rules that may be used in the present game can be found, for example, in Albert H. Morehead, et al., Hoyle's Rules of Games, Third Revised and Updated Edition (2001).

Figure 2:
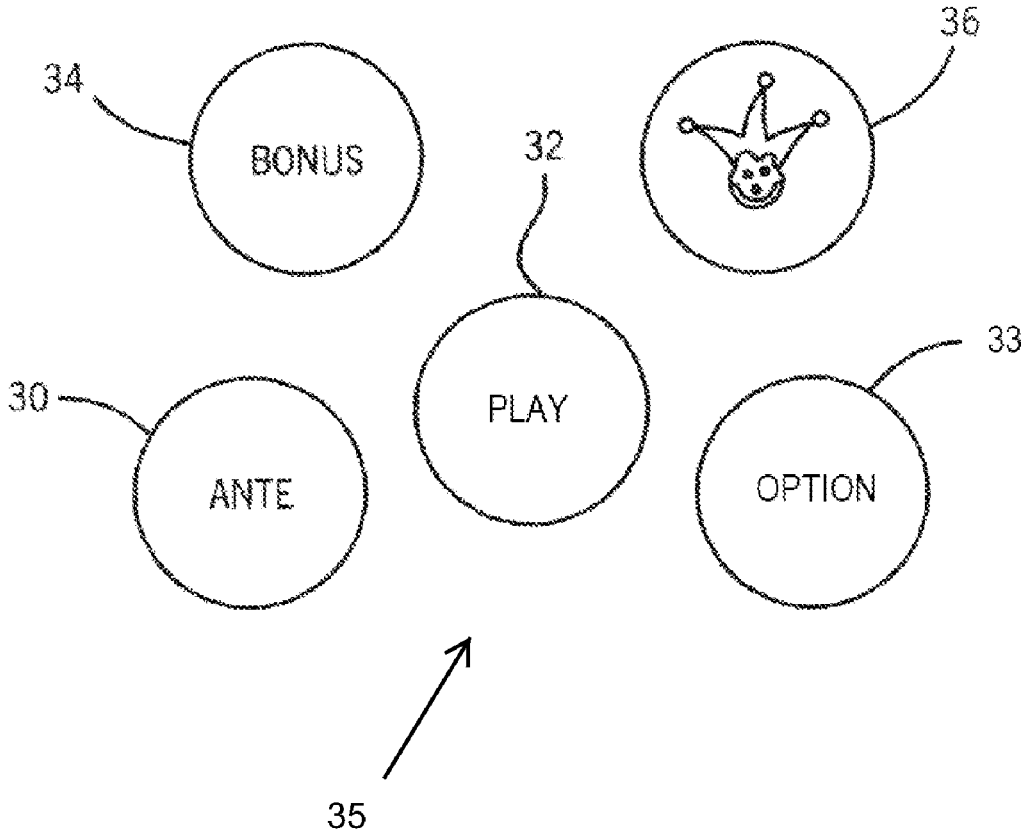
FIG. 2 is an illustration of a player's betting field in the present game.
Figure 4:
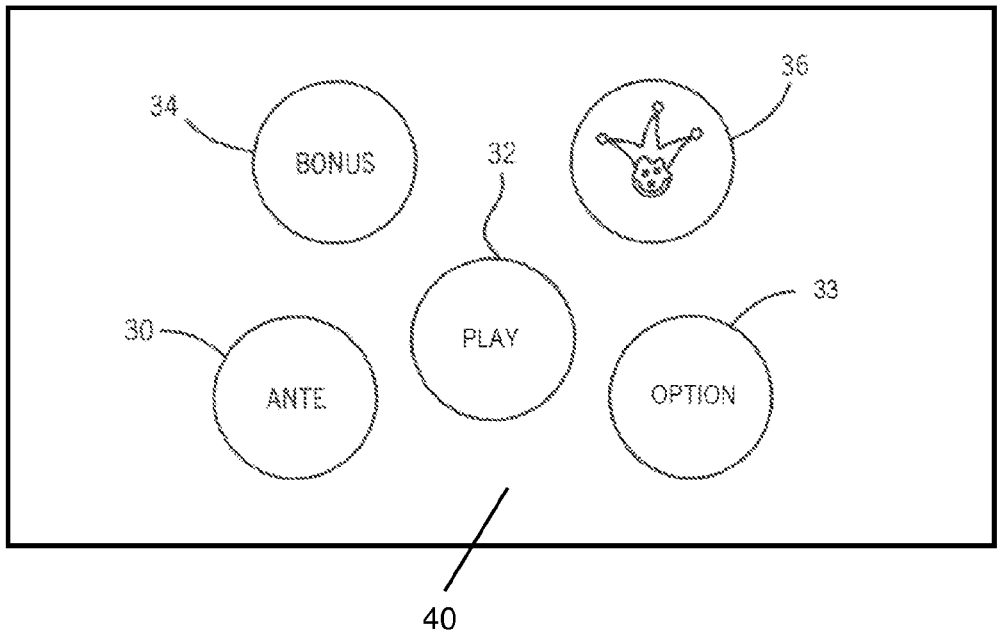
FIG. 4 is a top plan view of a board for use in playing the present game.

One of the unique aspects of the present game is the ability for a player to place a joker bet. In the present game, each of players has the option, before the deal or at least before learning what cards have been dealt to the player, to bet on whether the wild card used in the present game will be dealt into either the player's own hand or as one of the community cards (described below). This "joker bet" (referring to embodiments in which the wild card is a joker) is preferably made by placing chips or other consideration in a joker bet spot 36 on a gaming table 5, as shown in FIGS. 1 and 2, or on a playing board 40, as shown in FIG. 4.

The joker bet can preferably be won by a player even if the player folds his cards. In the present game, players are given an opportunity to fold before learning the identities of the one or more community cards used in the present game. Even after folding, a player can still win the joker bet, since a wild card may have been dealt as one of the community cards. This increases players' enjoyment of the present game, because a player who places a joker bet still has an opportunity to win this bet even if other bets (such as the ante) are lost due to the fact that the player was dealt cards forming a relatively low-ranked hand, thereby maintaining the player's interest in the game after having folded the player's hand.

Preferably, the joker bet is paid as soon as the event bet upon (i.e. the wild card appearing in either the player's hand or in a revealed community card) occurs. The payout from the joker bet, i.e. the payment made if a player wins the joker bet, can be a fixed payout in casino embodiments and can be different depending on whether the wild card is dealt into the player's own hand or whether it is dealt as one of the community cards. By setting a higher payout for the joker bet when a wild card is dealt as a community card, players' interest in the game can be maintained and even heightened as the game progresses. A higher payout for wild cards dealt as community cards than for wild cards dealt into a player's hand generally means that a player who has placed a joker bet will more eagerly anticipate the revelation of the identities of the community cards, and since the game does not end until the last community card is revealed, the higher payout helps to maintain interest in the game to its conclusion. Exemplary payouts for joker bets in a casino embodiment are shown in Table 2 below.

TABLE 2

Exemplary Joker Bet Payouts

| Joker Bet | Payout |
|---|---|
| Community Card | 10:1 |
| Player's Card | 4:1 |

Another unique aspect of the present game is that each player can additionally have the option, before the deal or at least before the player views the player's own cards, to bet on whether the cards in the player's own hand (preferably, together with any community cards) will form a hand that is higher than a predetermined rank, for example a five card straight or better. This "bonus bet" can be made, for example, by placing chips in a bonus bet spot 34 on the table 5, as shown in FIGS. 1 and 2, or on a playing board 40, as shown in FIG. 4. The bonus bet can also preferably be won by a player even if the player folds before the first community card is displayed, since the player's hand could be improved by the community cards.

Exemplary payouts for bonus bets are shown in Table 3 below. In some casino embodiments, the bonus bet may not require the gaming entity to have a qualifying hand in order for the gaming entity to be liable to pay a winning player. Preferably, bonus bet payouts are fixed payouts and can differ depending on whether or not a player's hand includes the wild card.

TABLE 3

Exemplary Bonus Bet Payouts

| Player's Hand (with Community Cards) | Payout |
|---|---|
| Any five card straight | 2:1 |
| Any five card flush | 3:1 |
| Any full house | 5:1 |
| Four of a kind with the wild card | 20:1 |
| Four of a kind without the wild card | 25:1 |
| Straight flush with the wild card | 50:1 |
| Straight flush without the wild card | 100:1 |
| Royal flush with the wild card | 150:1 |
| Royal flush without the wild card | 200:1 |
| Five of a kind deuces-kings | 250:1 |
| Five of a kind with aces | 1000:1 |

Casino Game

In one embodiment, the present game is played between two gaming entities, one of which is preferably a casino. In order to play this embodiment of the present game, a dealer deals cards to each of the players. Typically, a representative of the casino is also the dealer, in which case the dealer acts on behalf of the casino. The cards used in the present game are preferably shuffled before being dealt, in order to assure fairness, and must be shuffled if the cards are in an ordered state, such as a new deck of cards. Shuffling can be performed manually or with an automatic card shuffler.

As in other poker games, the present game involves a contest between players' hands. At the end of game play, players' hands are compared, and the player with the highest ranked hand is determined to be the winner. In this embodiment, one or more players each play against a single other gaming entity, such as a casino. FIG. 1 illustrates a table 5 arranged for playing this embodiment of the present game, in which individual players 15 (illustrated as players 12, 14, 16, 18, 20, and 22) each play against a dealer 38, preferably representing a casino.

In addition to contesting the ranks of players' hands, the present game provides wagering opportunities. In this embodiment, the gaming table 5 at which the present game is played is provided with a betting field 35 comprising discrete areas for placing a plurality of different wagers during different wagering opportunities of the present game. FIGS. 1 and 2 illustrate a preferred embodiment of such a betting field 35. In addition to providing areas for a player's ante (ante area 30), first round bet (play area 32), and second round bet (option area 33), players of the present game have the ability to wager on other features of the game in bonus area 34 and joker area 36, as described further below.

At the beginning of game play, and preferably prior to dealing any cards, each player playing against the casino preferably places an ante bet, such as by placing chips or other consideration on the ante spot 30. Following the placement of an ante bet by each player 15, the dealer 38 then deals at least two cards 24 to each of the players 15 (including the dealer 38). In a preferred embodiment, at least two cards, preferably at least three cards, more preferably at least four cards, and even more preferably at least five cards are dealt to each player 15, although other numbers of cards can also be distributed.

Following the dealing of cards to each player 15, the dealer 38 then deals at least one, and more preferably at least two community cards 28 in a manner so as not to reveal the identities of the community cards, such as by placing them face down on the table 5. The number of cards in a player's hand and the number of community cards dealt must total at least five cards when standard poker rules (as set forth above in Table 1) are used to rank players' hands. More preferably, the number of cards in a player's hand and the number of community cards dealt total six, seven, or more cards when standard poker rules are used to rank players' hands. Cards dealt to players are preferably dealt prior to dealing or revealing any community cards, but one or more cards can be dealt to a player after a community card is dealt or its identity revealed. In some embodiments, a player may be allowed to draw one or more cards before or after the identity of the first community card is revealed.

The community cards 28 can be used by each of the players 15 (including the dealer 38 as appropriate) to derive the best hand using a combination of the community cards and/or the cards in each player's hand. For example, if a player is dealt five cards and there are two community cards, and if rankings are based on five card hands as provided by standard poker rules, each player has the opportunity to choose which five cards to use to form the player's hand from among the seven cards that are either in the player's hand or were dealt as community cards.

Before the identity of one or more of the community cards 28 is revealed, each player 15 in the game other than the casino must place a bet on whether its hand will be higher in rank than that of the casino, such as by placing chips into the play spot 32. If no bet is placed, the player folds his or her hand and thereby lose the player's ante, before the first community card 28 is revealed. The identity of the first community card 28 is then revealed. In embodiments in which two community cards 28 are dealt, players must check or bet again before the second community card 28 is revealed, such as by placing chips onto the option spot 33, after which the identity of the second of the community cards 28 is revealed. In alternative embodiments, additional community cards and associated betting opportunities can be provided.

Following the revelation of the identities of all the community cards, the highest-ranked five card hand that can be made from cards in the casino's hand and from the community cards is compared with the highest-ranked five card hand that can be made from cards in each of the other players' hands in combination with any community cards, in order to determine the winner of this portion of the present game. In this embodiment, the casino preferably must have a hand which is higher in rank than a predetermined rank, i.e. a qualifying hand, before the casino becomes liable to pay bets made prior to revealing each of the community cards 28. The qualifying hand can be a pair of fours or better, a pair of fives or better, or can be another hand of predetermined rank.

Figure 3:
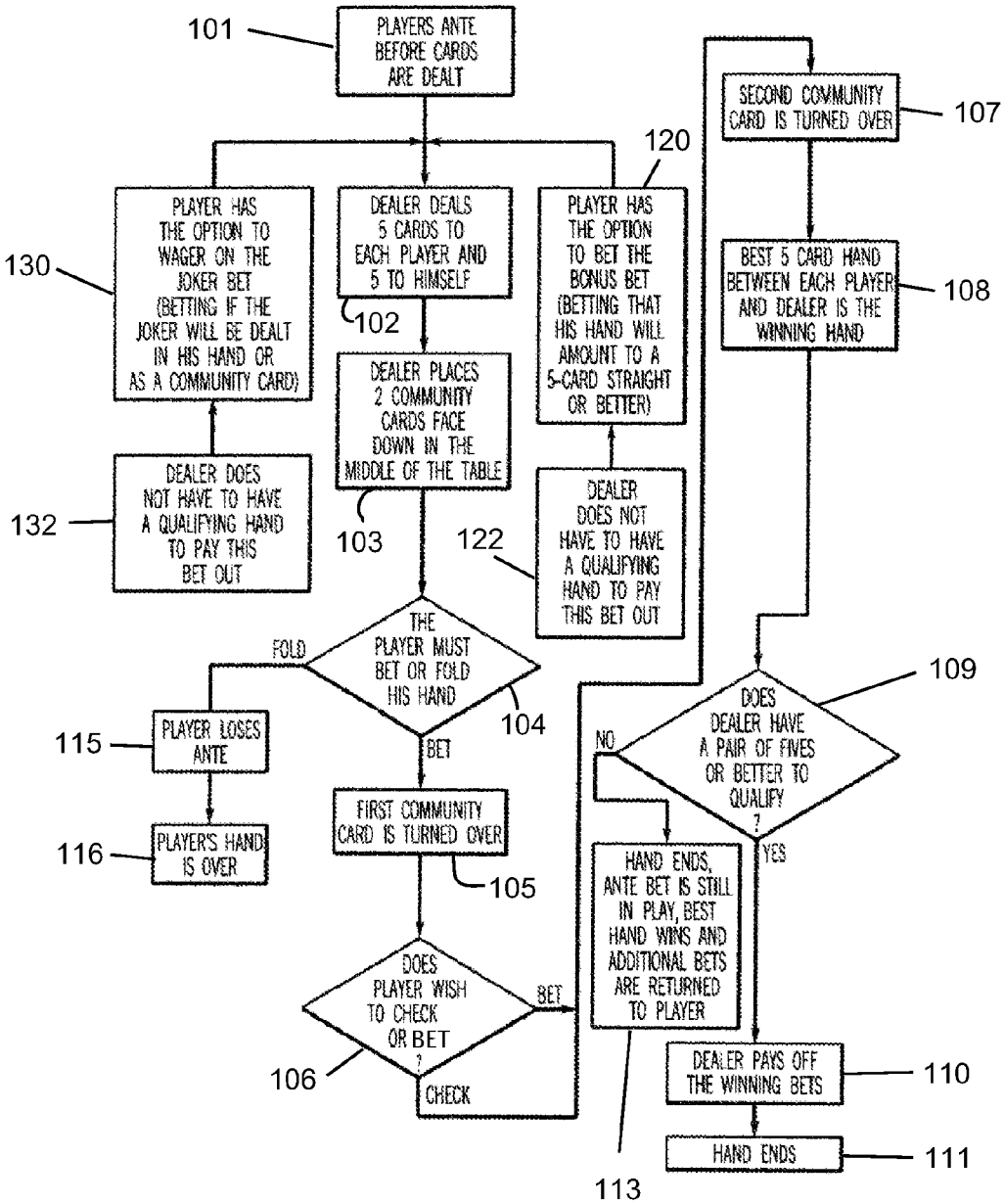
FIG. 3 is a flow chart illustrating the steps involved in playing an embodiment of the present game.

The steps involved in a preferred embodiment of the present game are shown in the flowchart of FIG. 3. In step 101, the players of the game other than the dealer (representing a casino) first place an ante bet prior to any cards being dealt. The same players next have the option, prior to cards being dealt, to place one or both of a bonus bet (step 120), in this case whether the player's hand will be a 5 card straight or higher, and a joker bet (step 130), in this case a wager on whether the wild card (e.g., a joker) will be dealt into either the player's hand or as a community card. The dealer next deals five cards to each player and to himself in step 102. Cards are dealt so that the dealer and players do not see each other's cards. In step 103, the dealer next deals two community cards face down in the middle of the gaming table.

In the next step, step 104, each player other than the dealer must either place a bet or fold. If a player folds in step 104, then that player loses his ante to the dealer (step 115). The bonus and joker bets preferably remain in play even if the player folds at this step or later, prior to the end of the hand at step 111. The game is otherwise over for that player (step 116). Once players place bets in step 104, the dealer then turns over (reveals the identity of) one of the community cards in step 105. The remaining players (other than the dealer) then must either place another bet, check, or fold in step 106. If a player folds in step 106, then that player loses his ante and first bet to the dealer (step 115) and the game is over for that player (step 116), other than with respect to the joker and bonus bets. Once players either check or place further bets, the second community card is then turned over (step 107). In step 108, the best five card hand (using standard poker rankings for hands) is determined for the dealer and for each of the remaining players, using the community cards and the cards in each player's hand. The highest ranking hand is declared the winner. Thus, step 108 involves determining whether the casino or an individual player has the higher hand, and the higher hand as between the individual player and the casino is declared the winner of the hand.

In step 109, the dealer's hand is evaluated to determine whether it is as high as or higher than a predetermined qualifying hand, in this case a pair of fives. If the dealer has a qualifying hand, and if a player is determined to have a higher ranked hand than the dealer, then in step 110 the dealer pays the amount bet by the player during step 101 (the ante), step 104, and step 106, and the hand ends (step 111), other than with respect to the joker and bonus bets. If the dealer has a qualifying hand, and if a player is determined to have a lower ranked hand than the dealer, then in step 110 the dealer collects the amount bet by the player during step 101 (the ante), step 104, and step 106, and the hand likewise ends.

Following step 107 or contemporaneously therewith, but preferably at the end of the hand, the hand of a player who has placed a bonus bet in step 120 is evaluated to determine whether the player's hand is higher than the predetermined rank necessary to win the bonus bet. If the player is determined to have a hand which is higher than the predetermined rank necessary to win the bonus bet, then the dealer pays the fixed payout associated with the bonus bet. Step 122 clarifies that the dealer's hand is not evaluated to determine whether it is a qualifying hand for the bonus bet, i.e. whether it is as high as or higher than a predetermined rank.

Following step 107 or contemporaneously therewith, but preferably at the end of the hand, the cards dealt to a player who has placed a joker bet in step 130 and the community cards are evaluated to determine whether the player has won the joker bet. If the player is determined to have won the joker bet, then the dealer pays the fixed payout associated with the joker bet. Step 132 clarifies that the dealer's hand is not evaluated to determine whether it is a qualifying hand for the joker bet, i.e. whether it is as high as or higher than a predetermined rank.

Multiplayer Game

In alternative embodiments, the present game can be played by individuals without a casino or other gaming entity against which each individual player plays. The present game is played as described above, except that at the end of game play, players' hands are compared, and the player with the highest ranked hand is determined to be the winner of the hand.

Bonus and joker bets can be made by individual players in this embodiment, with the winners of such bets splitting the total bet (pot) associated with each such bet, in the manner of a side pot. Alternatively, each player can be required to place a joker and/or a bonus bet prior to play in the manner of an ante bet, with the winners of such bets splitting the total bet associated with each bet (joker bet or bonus bet, respectively). In such embodiments, players may be required to have a qualifying hand in order to be eligible to receive a payout on a joker bet or bonus bet. If no player in wins or qualifies to receive a payout on a joker or bonus bet, then the amounts placed for such bets can either be kept in play for a later hand to be played by the players involved in the game, or the amounts bet by each player can be returned to that player.

Game Formats

Board Games

The present game can be played using conventional playing cards, as generally described above. In one embodiment, the present game can be played using a game board in place of a gaming table at a gaming establishment. When the present game is played as a board game, the game is preferably provided with an appropriate set of cards, including at least one wild card, tokens for wagering, and a board. The board 40 comprises a one or more areas for placing wagers, i.e. betting fields, as illustrated in FIG. 4. The areas are an ante bet area 30, a wild card (joker) bet area 36, a bonus bet area 34, and two areas for bets relating. to the strength of a player's hand, a "play" bet area 32 and an "option" bet area 33. Indicia, whether words, numbers, colors, graphics, other indicia or a combination of indicia, can be used to differentiate the foregoing betting In one embodiment, each board comprises more than one set of five betting fields, so that more than one player can make use of the same board. Alternatively, a plurality of different boards can be provided as a set, for example a set of eight boards, with each board comprising a single set of five betting fields, as shown in FIG. 4. In another alternative embodiment, coasters or other means for defining the boundaries of an area can be used to designate each of the five betting fields, rather than using a board that defines such areas.

Boards for use with the present board game can be conventional cardboard boards, as used in conventional board games, and can be provided with folds or cuts that allow the board to be folded for storage. Alternatively, the board can be made from a flexible material, such as cloth or a flexible polymer material, which allows the board to be rolled, folded, or otherwise reduced in size for storage. The board, cards, and tokens are preferably packaged together in a box.

In this embodiment, the present game can be played in the manner of the casino game described above, except that players preferably take turns playing the role of the casino, with the player taking the role of the casino preferably rotating after each hand, so that a different player plays this role each hand, A "button" or other indicia to identify the player playing the role of the casino is preferably provided. Alternatively, game boards can be used to play the present game in a multiplayer format.

This embodiment is particularly useful to individuals who are not permitted to gamble, such as individuals below the legal age for gambling in a particular jurisdiction, or who do not wish to gamble, or who are in jurisdictions or situations where gambling is not permitted. In such cases wagering can be performed using tokens which have nominal value. Such tokens can for example be plastic chips provided with the present board game.

Electronic Games

In another embodiment, the present game can be played in electronic form. In this embodiment, the role of the dealer and/or one or more other players is performed by hardware and/or software resident in one or more devices, such that the present method is directed to conducting a game between a computer-controlled player and at least one live player. When an electronic device is operated by a gaming entity and is delegated the authority to take wagers, the electronic device, in representing the gaming entity, can be deemed a gaming entity for purposes of the present methods. Electronic versions of the present game can also be played using nominal tokens or consideration, as described above for board games. The other physical components of the present game, such as a board, table, and/or cards, can also be displayed or represented in electronic form. The game can be played for example on a device similar to a video poker slot machine at a casino, i.e. a machine which displays cards.

In one embodiment, electronic versions of the present game can be played as described above for embodiments in which individual players each play against a casino, with the video slot machine or other electronic device playing the role of the casino and dealer, and with cards being displayed in electronic form. In an alternative embodiment played electronically, two wild cards are used in the deck employed in the game. A draw is also preferably implemented in this embodiment, so that a player may discard between one and three cards and receive an equal number of cards from the electronically displayed deck, prior to the time that the identity of the community cards is revealed.

The devices used in this embodiment can be standalone devices, for example a slot machine or other device located in a casino which is capable of receiving coins, bills, or other consideration, including in electronic form. Alternatively, the game can be played on and/or operated by general purpose computing devices, such as desktop computers, laptop computers, tablet computers, mobile phones, or other data processing devices. Such gaming devices preferably comprise a processor, an interface with a player which is in communication with the processor, a data storage in communication with the processor, and a display device. The data storage stores instructions executable by the processor to conduct the game. The instructions include a game program that receives input including wagers from the live player through the interface. The live player of the present game in electronic form can input information in ways known to the art, such as using a touch screen, keyboard, keypad, or pointing device, and can view game play using displays known to the art, such as monitors, mobile phone screens, touch screens, and other devices. In embodiments using touch screens, the input device and display device can be the same component of the present game. With devices not located on the premises of a gaming entity, wagering can be accomplished using electronically transmitted remuneration, where allowed by law.

The processor of the present device can be, for example, a microprocessor, a microcontroller-based platform, a suitable integrated circuit or one or more application-specific integrated circuits (ASIC's). The processor is in communication with or operable to access or to exchange signals with at least one data storage or memory device. The processor and the memory device can optionally reside within the cabinet of a gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. The memory device can include random access memory (RAM) and/or read only memory (ROM). For example, the memory device can include flash memory and/or EEPROM (electrically erasable programmable read only memory). Any other suitable magnetic, optical and/or semiconductor memory may be implemented in conjunction with a gaming device used to play the present game.

Software for operating the present game in electronic form can be implemented either locally on a device being operated by a player, or can alternatively be implemented over a network, in which case the software is resident either entirely or at least partly on a networked server. In this embodiment, gaming devices are connected over a network or through a remote communication link with a central server or controller which provides some or all of the functions of the gaming device. The processor of each gaming device may be designed to facilitate transmission of signals between the individual gaming device and the central server or controller.

In one embodiment, game outcomes are provided by a central server to a player using an electronic device to play the present game. In this embodiment, when actions determinative of the outcome of the game need to be provided, such as providing the identity of cards dealt to players and as community cards, a device used to play the present game contacts a central server and requests the information needed to take such actions in the game. The central server receives the request and randomly generates the information needed based on probability data.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. In another embodiment, the data network can be the internet or an intranet. In this embodiment, the operation of the gaming device can be viewed at the gaming device with at least one internet browser. Operation of the gaming device and accumulation of credits in this case may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection.

Example

A player playing against a casino dealer places an ante bet, a bonus bet and a joker bet prior to cards being dealt, by placing chips in the respective spaces on the table in front of the player which are marked "ante," "bonus," and "joker" (or with a joker logo). The player and then the dealer each receive five cards, and two community cards are dealt face down in the middle of the table.

After the deal and prior to the first community card being revealed, the player decides to continue playing rather than folding by placing a play bet, i.e. by placing chips on the space on the table in front of the player marked "play." The play bet must be double the ante. After the first community card is exposed and prior to the second community card being turned over, the player places an option bet by placing chips on the space on the table in front of the player marked "option." The option bet must also be double the ante. Once the two community cards are shown, the dealer's hand is revealed. If the dealer has a qualifying hand of a pair of fives or better, and if the player has a higher ranked hand than the dealer, then the player's ante, play bet, and option bet are paid even money.

If the dealer does not have a qualifying hand, the play and option bets are returned to the player and the player will be paid even money on the ante if the player's hand beats that of the dealer. The player will lose the ante if the dealer's hand beats the player's hand. After all hands are shown, the joker and/or bonus bets are paid if they are won by the player.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A method of playing a card game with two or more players using an electronic device, wherein the game utilizes a set of playing cards that comprises a wild card, the method comprising the step of causing a program to execute the following instructions:

(a) providing a first betting opportunity for a player to place a first bet that the player's hand will be higher in rank than a first predetermined rank, wherein hands are ranked according to predetermined rules;

(b) providing a second betting opportunity for a player to place a second bet that the wild card will be dealt into the player's hand or as a community card;

(c) after steps (a) and (b), providing a hand comprising at least two cards to each player and providing at least a first community card, wherein the first community card is provided in a manner that conceals the first community card's identity;

(d) providing a third betting opportunity after the first community card is provided for a player to place a third bet that cards from the player's hand, in combination with any community cards, can form a hand which is higher in rank than the hands of other players against whom the player is betting;

(e) revealing the identity of the first community card;

(f) determining which player has the hand with the highest rank;

(g) paying the third bet to the player having the hand with the highest rank;

(h) paying the first bet to a player if cards from the player's hand in combination with any community cards form a hand that is higher in rank than the first predetermined rank;

(i) paying the second bet to a player if the wild card was dealt into the player's hand during the game; and (j) paying the second bet to a player if the wild card was dealt as a community card during the game, wherein the amount of the second bet paid to the player if the wild card was dealt as a community card is higher than if the wild card was dealt into the player's hand.

2. The method of claim 1, further comprising the steps of:

providing a second community card in a manner that conceals the second community card's identity after the first community card is provided;

providing each player with a fourth betting opportunity after the second community card is provided, wherein each player must check or place a fourth bet during the fourth betting opportunity;

revealing the identity of the second community card; and paying the amount of the fourth bet to the player having the hand with the highest rank.

3. The method of claim 1, wherein the game is played with only two players.

4. The method of claim 1, wherein one of the players is a casino.

5. The method of claim 4, wherein the casino must have a hand of a predetermined rank or higher in order to pay the third or fourth bets.

6. The method of claim 4, wherein the first bet and the second bet are fixed payout bets.

7. The method of claim 1, wherein step (c) comprises dealing at least four cards to each player.

8. The method of claim 1, wherein step (c) comprises dealing five cards to each player.

9. The method of claim 1, wherein a player can discard one or more cards and be provided with an equal number of cards after being provided with cards in step (c).

10. The method of claim 1, wherein the set of cards is a standard 52-card deck of cards and the wild card.

11. The method of claim 10, wherein the wild card is a joker.

12. The method of claim 1, wherein the set of playing cards comprises two wild cards.

13. The method of claim 1, wherein a player must either fold or place a bet during the third betting opportunity.

14. The method of claim 1, further comprising the step of placing an ante prior to step (a), wherein the ante is paid to the player having the hand with the highest rank.

15. The method of claim 1, wherein the predetermined rules are standard poker rules.

16. The method of claim 1, wherein the electronic device is a server.

17. The method of claim 16, wherein the server communicates with one or more gaming devices over a network.

18. The method of claim 16, wherein cards are displayed on a mobile device.

19. The method of claim 18, wherein the mobile device is selected from the group consisting of a laptop computer, a tablet computer, and a mobile phone.

20. The method of claim 1, further comprising the step of receiving wagers from a player through an interface.

21. The method of claim 1, wherein the interface is selected from the group consisting of a touch screen, a keyboard, a keypad, or a pointing device.

22. The method of claim 1, wherein the electronic device is capable of receiving remuneration.

* * * * *